United States Patent [19]

Myers

[11] 4,381,702

[45] May 3, 1983

[54] DISPLACEMENT CONTROL FOR A HYDRAULIC PUMP OR MOTOR WITH FAILURE OVERRIDE

[75] Inventor: H. Allen Myers, Ames, Iowa

[73] Assignee: Sundstrand Corporation, Rockford, Ill.

[21] Appl. No.: 209,069

[22] Filed: Nov. 21, 1980

[51] Int. Cl.[3] ..... F01B 13/04; F04B 1/22

[52] U.S. Cl. ..... 91/506; 60/403; 60/443; 417/217; 417/222

[58] Field of Search ..... 417/212, 217-222; 60/443, 444, 445, 403; 91/506

[56] References Cited

U.S. PATENT DOCUMENTS

| | | | |
|---|---|---|---|
| 3,510,231 | 5/1970 | Bobst | 417/218 |
| 3,633,464 | 1/1972 | Aoyama | 60/445 |
| 3,881,317 | 5/1975 | Swoager | 60/445 X |
| 3,946,560 | 3/1976 | MacIntosh et al. | 60/421 |
| 4,227,443 | 10/1980 | Toot | 91/459 |

*Primary Examiner*—Edward K. Look

*Attorney, Agent, or Firm*—Wood, Dalton, Phillips, Mason & Rowe

[57] ABSTRACT

A displacement control for a pump or motor having a swash plate for setting displacement includes a control device operatively connected to the swash plate and a control valve having connections to a source of pressure and drain for operating said control cylinder. The control valve has a neutral position wherein the swash plate is at or near a minimum displacement position. The control valve is operable to other positions for setting the displacement of the pump or motor and, additionally, is movable to a control position other than the neutral position or normal displacement-setting positions in response to an operative failure of the control valve positioning system which enables the swash plate to move to a position which minimizes any adverse effects from the occurrence of said operative failure. In a pump, the swash plate moves to a zero displacement position upon the occurrence of a failure while, in a motor, the swash plate moves to a maximum displacement position.

19 Claims, 6 Drawing Figures

DISPLACEMENT CONTROL FOR A HYDRAULIC PUMP OR MOTOR WITH FAILURE OVERRIDE

BACKGROUND OF THE INVENTION

This invention pertains to a failure override system for an hydraulic pump or motor displacement control whereby, upon a failure in the system, the pump or motor is set in a nondisplacement or displacement position, respectively, which minimizes the adverse effects resulting from the failure.

Hydrostatic transmissions are now well known wherein a pump and motor are connected in fluid circuit and with one or both of the pump and motor having variable displacement whereby the characteristics of the system, such as the output speed of the motor, may be varied. Such hydrostatic transmissions have many different uses, with one use thereof being in the drive train for a vehicle. An example of use of two such transmissions for driving a dual track vehicle is shown in MacIntosh et al U.S. Pat. No. 3,946,560, owned by the assignee of this application.

There are many different known methods for setting the displacement of a variable displacement pump or motor. Common to many of these systems is the use of a control valve which controls the connections of a pair of positioning piston and cylinders associated with the swash plate to either a source of control pressure or drain. This control valve can be positioned mechanically, hydraulically, or electrically and may or may not have feedback means associated therewith for feeding back the position of the swash plate to the control valve. In many instances, it is possible for a failure to occur in a component associated with positioning of the control valve, with the result that the control valve can move to a position to cause swash plate positioning which would have adverse effects. If a failure occurs in the control for the pump, it is possible for the control valve to move to a position whereby the swash plate would move rapidly to and remain at a full displacement position which could cause a rapid rise in the speed of the motor and create hazardous conditions as by causing a vehicle utilizing the transmission to inadvertently increase in speed.

In the control of a motor, particularly when the hydrostatic transmission is associated with a vehicle for drive thereof, it is desirable to have the motor go to a maximum displacement position upon a failure in the system.

Examples of possible failure are failure of a spring in a system having springs utilized to provide for spring centering of the control valve, a failure in the hydraulic or electrical system for positioning of the control valve, or a failure caused in a mechanical system, such as breaking of a link or a pivot point in the structure which sets the position of the control valve or in the feedback structure which relates the position of the control valve to that of the swash plate and wherein spring means are associated with the feedback structure to urge the structure in a direction to eliminate undesirable effects of backlash.

SUMMARY OF THE INVENTION

A primary feature of the invention disclosed herein is to provide means for overriding a failure in the system for operating a displacement control valve in a hydraulic pump or motor control in order to minimize adverse effects resulting from said failure. More particularly, the invention relates to a failure override system with respect to a displacement control for a pump or motor in which a control valve travels to an extreme normally not used control position upon the occurrence of a failure in the means which normally operates to position the control valve.

In accordance with the foregoing, an object of the invention is to provide means for overriding a failure in a displacement control for a variable displacement pump or motor and minimizing the adverse effects which could otherwise occur.

Another object of the invention is to provide a displacement control for a variable displacement fluid translating device having a movable member for controlling displacement, a circuit including a control device operatively connected to said movable member and a control valve having connections to a source of pressure and a drain for hydraulically operating said control device, said control valve having a neutral position wherein said movable member is at or close to a neutral position and at least one other position wherein said movable member is in a displacement-setting position, means for setting the position of the control valve, and said control valve being movable to a control position not achieved in normal operation in response to an operative failure of said position-controlling means and having means at said control position which enables the movable member to move to a position which minimizes any adverse effects from said failure.

Still another object of the invention is to provide a displacement control for a variable displacement pump having a swash plate for controlling displacement, a circuit including a control device operatively connected to said movable member and a control valve having connections to a source of pressure and a drain for hydraulically operating said control device, said control valve having a neutral position wherein said movable member is in a neutral position for zero displacement and a range of other positions wherein said swash plate is in a displacement-setting position, means for setting the position of the control valve, and said control valve being movable to a control position other than said neutral position in response to an operative failure of said position-controlling means which enables the movable member to move to said neutral position.

Still another object of the invention is to provide a displacement control for a variable displacement motor having a swash plate for controlling displacement, a circuit including a control device operatively connected to said swash plate and a control valve having connections to a source of pressure and a drain for hydraulically operating said control device, said control valve having a neutral position wherein said movable member is in a minimum displacement-setting position and at least one other position wherein said swash plate is in a displacement-setting position, means for setting the position of the control valve, and said control valve being movable to a normally unused control position in response to an operative failure of said position-controlling means which causes the swash plate to move to a maximum displacement position.

In carrying out the foregoing objects and in the particular embodiments disclosed, the control valve is urged to an extreme position by spring means in order to take up backlash in a mechanical linkage including feedback structure which controls the position of the control valve. The spring means urges the control valve to an extreme control position when a failure in the mechanical linkage occurs and the control valve has flow passages operative in the extreme position to enable the desired setting of the swash plate. When used in control of a pump, the control device for the swash plate includes a pair of pistons and cylinders with spring means which normally urge the swash plate to a zero displacement position when the control valve is in a neutral position. In the control position upon the occurrence of a failure, the control cylinders are connected to drain and disconnected from the source of pressure whereby the swash plate assumes its neutral position. In the motor control, the control valve has flow passages operative in the extreme control position thereof which connect one of a pair of control cylinders associated with the swash plate to a source of pressure and the other control cylinder to drain whereby the swash plate is moved to a maximum displacement position.

DESCRIPTION OF THE PREFERRED EMBODIMENTS

Figure 1:
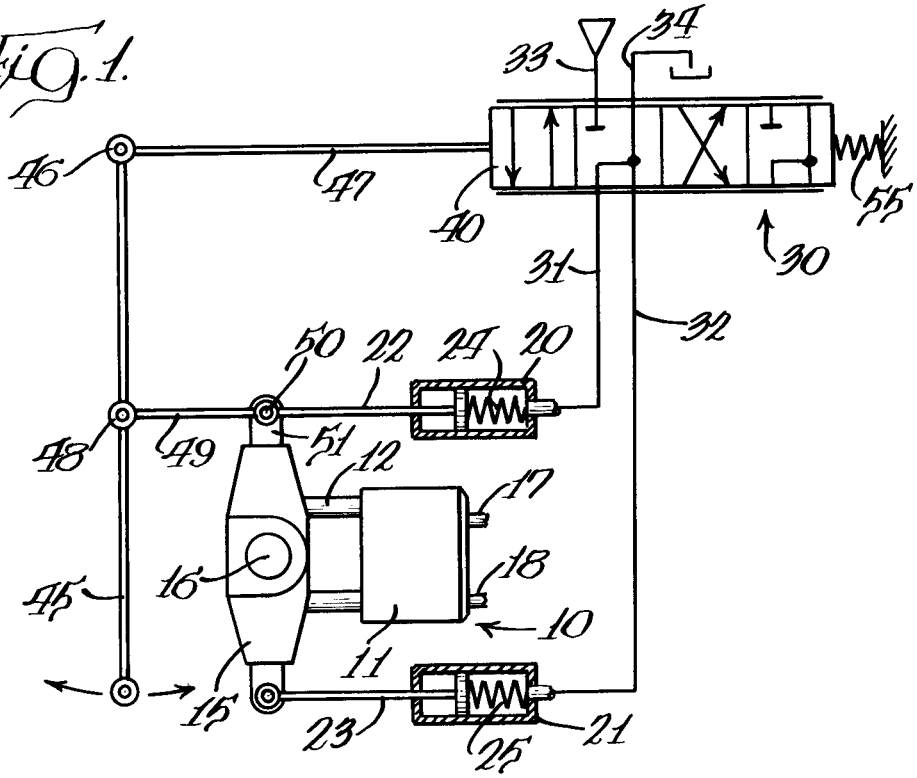
FIG. 1 is a schematic view of the displacement control for a variable displacement pump and having the failure override associated therewith.
Figure 2:
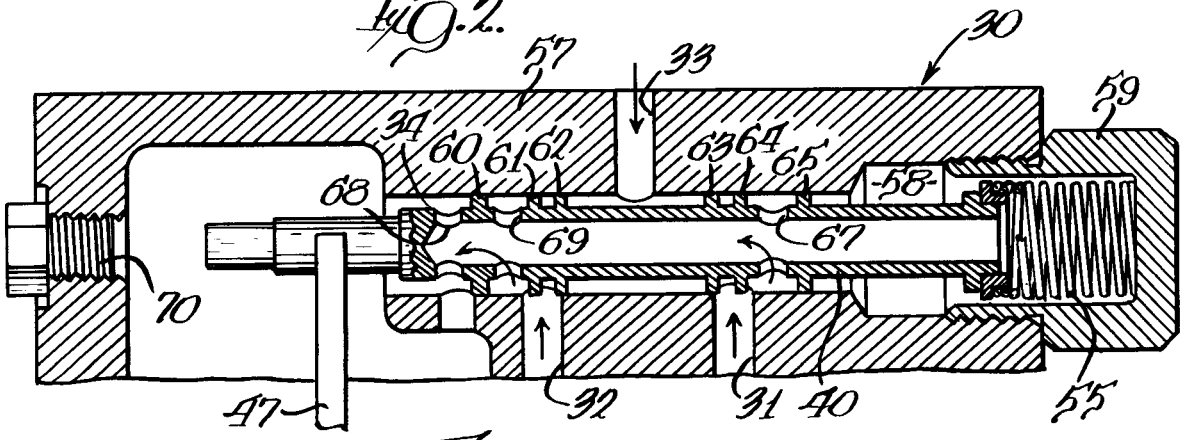
FIG. 2 is a longitudinal central sectional view of the control valve in neutral position and having the operative fluid connections shown in FIG. 1.
Figure 3:
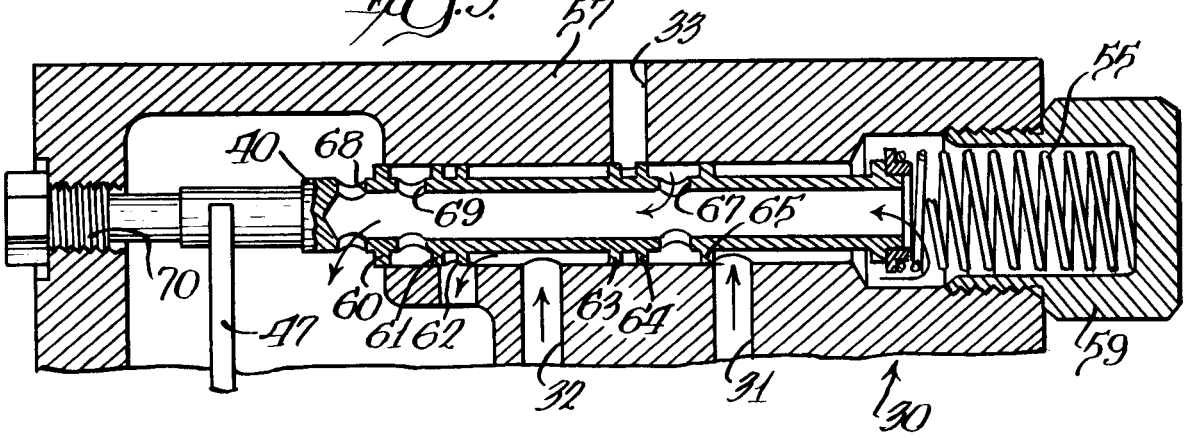
FIG. 3 is a view, similar to FIG. 2, showing the control valve in an extreme control position causing the failure override.
Figure 4:
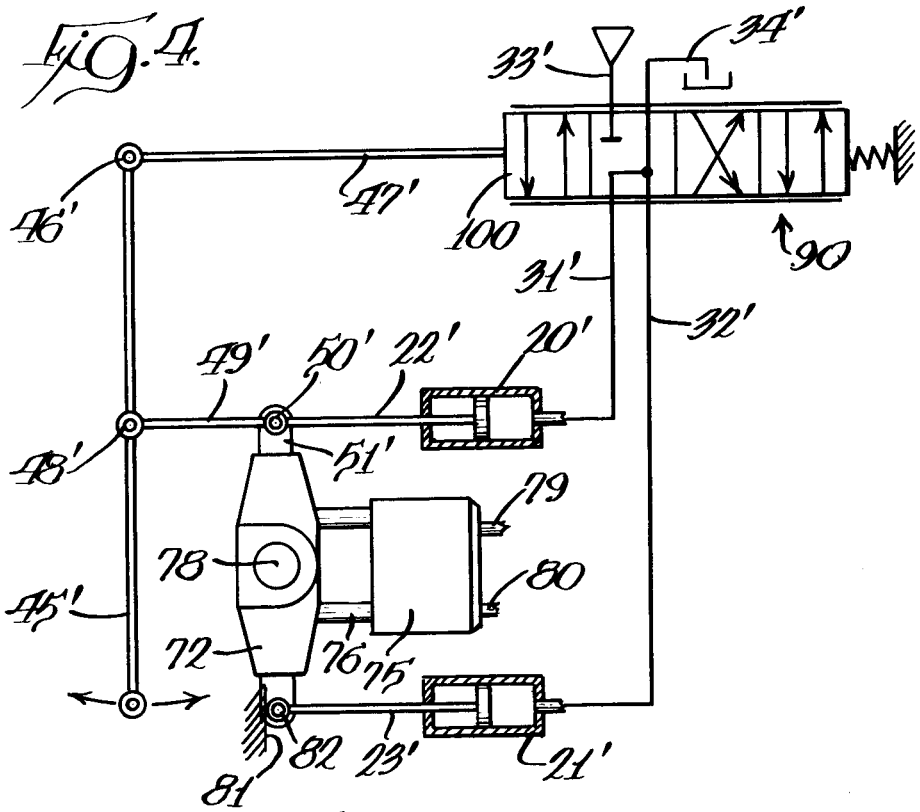
FIG. 4 is a schematic view of the failure override control for a motor.
Figure 5:
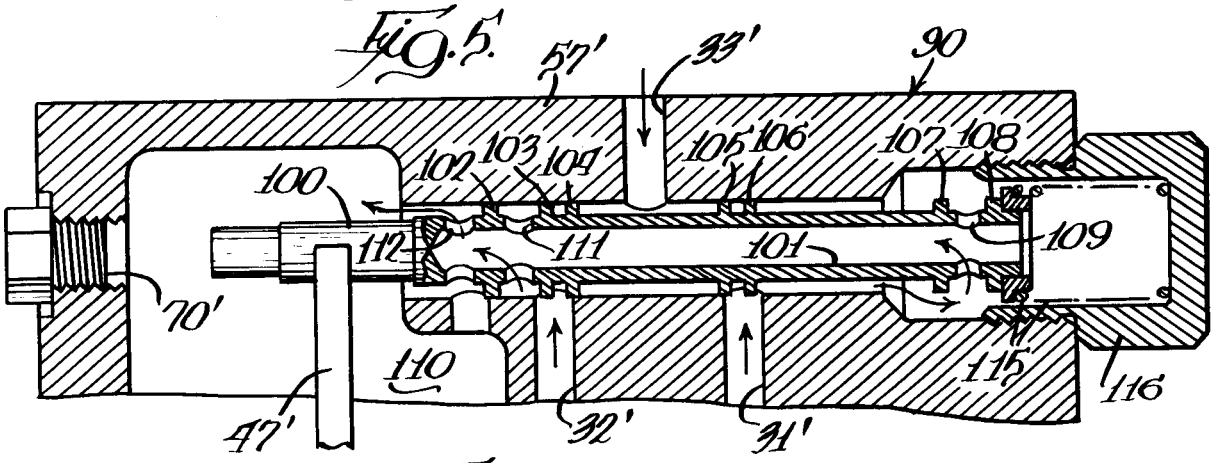
FIG. 5 is a central longitudinal section of the control valve, shown in FIG. 4, and having the operative fluid connections shown in FIG. 4.
Figure 6:
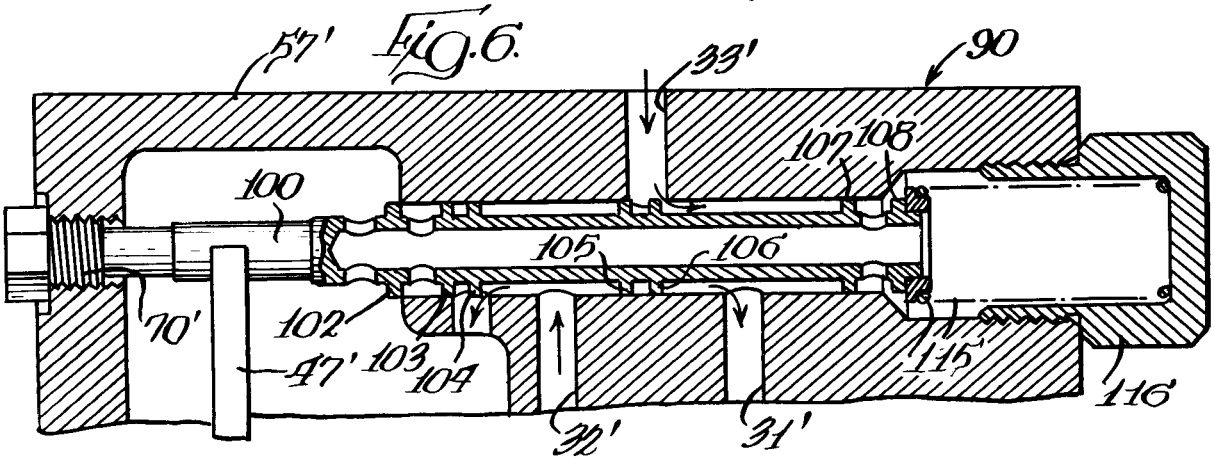
FIG. 6 is a view, similar to FIG. 5, showing the control valve positioned in an extreme control position for failure override.

The failure override for two types of variable displacement fluid-translating device is shown in the drawings with the failure override for a variable displacement pump being shown in FIGS. 1 to 3 and for a variable displacement motor being shown in FIGS. 4 to 6.

Referring to the pump displacement control shown in FIGS. 1 to 3, a pump is shown generally at 10 and is of the axial piston type having a rotatable barrel 11 having a series of reciprocal pistons 12 which have their stroke controlled by a movable member 15 in the form of a swash plate. The swash plate is pivoted about an axis 16 for setting displacement and controlling hydraulic flow through one or the other of a pair of lines 17 and 18 leading to an operated device, such as a motor. The swash plate 15 is shown in neutral position for zero displacement from the pump and the swash plate is movable in either clockwise or counterclockwise direction for establishing pump displacement and with flow through one or the other of lines 17 and 18 to the motor.

The position of the swash plate is under the control of a control circuit including a control device operatively connected to the swash plate 15 and, as shown, the control device includes a pair of cylinders 20 and 21 having piston rods 22 and 23, respectively, which connect to the swash plate. Each of the cylinders 20 and 21 has a respective spring 24 and 25 associated therewith in order to place the swash plate in a neutral zero displacement position in the absence of pressure in the cylinders.

The control circuit additionally includes a control valve, indicated generally at 30, which controls the connection of a pair of cylinder lines 31 and 32 extending to the respective cylinders 20 and 21, to either a source of pressure fluid existing in line 33 or to a drain line 34.

The control valve 30 has a spool 40 having a neutral position shown in FIG. 1 wherein the pressure line 33 is blocked and the cylinder lines 31 and 32 are connected to the drain line 34. The control valve is shiftable to a range of positions at either side of neutral for setting the displacement-setting position of the swash plate 15. If the valve spool 40 moves toward the right as viewed in FIG. 1, pressure fluid is delivered to the line 31 and cylinder 20 to cause counterclockwise movement of the swash plate, while the cylinder 21 is connected to the drain line 34 to permit this movement. Conversely, if the control valve is shifted to the left, as viewed in FIG. 1, the connections are reversed whereby pressure fluid is delivered to the cylinder line 32 and the cylinder line 31 is connected to the drain line 34 whereby the cylinder 21 is operative to move the swash plate 15 in a clockwise direction.

The control valve 30 can be positioned to the various positions described by mechanical, hydraulic or electrical means and, as shown in FIG. 1, the means is in the form of a mechanical linkage including a command link 45 which can be manually operated or operated from a remote source by suitable means. The command link has a pivot connection at 46 to a link 47 connected to the valve spool 40 and a pivotal connection 48 to a link 49 with the latter link being pivoted at 50 to an arm 51 fixed in relation to the swash plate 15. The command link 45 is shown in a position to place the control valve in neutral position. Movement of the command link about the pivot 48 results in movement of the valve spool 40 either to the right or the left, depending on the direction of rotation of the command link, to shift the control valve from the position shown in FIG. 1. The links 49 and 51 by connection to the command link 45 at pivot 48 constitute feedback means whereby the position of the swash plate is fed back to the control valve to result in modulating the position of the control valve to maintain the commanded position of the swash plate.

A spring 55 engages an end of the valve spool 40 and urges the control valve spool towards the left, as viewed in FIG. 1, to eliminate backlash in all of the linkage connections in order to eliminate the undesirable effects of backlash on control operation and avoid the necessity for precise dimensional control of pivot clearances. In the event that any of the links or pivot connections thereof should break, the spring 55 could become operative to shift the valve spool 40 toward the left, as viewed in FIG. 1, and cause rapid movement of the swash plate 15 in a clockwise direction because of delivery of control pressure to the cylinder line 32 and without any feedback from the swash plate to the control valve. When the pump is used in drive of the vehicle as well as in other applications this could result in a potential hazard. In a vehicle application, this could result in rapid increase in speed of the vehicle.

The invention incorporates a failure override by incorporating a fourth valve position, indicated symbolically at the right in FIG. 1, wherein the cylinder lines 31 and 32 are connected to the drain line 34 and the pressure line 33 is blocked. The result of the fourth position of the control valve is that the pressure is released from the control cylinders 20 and 21 and the springs 24 and 25 are operative to move the swash plate 15 to a neutral position wherein the pump has zero displacement so that no fluid is delivered from the pump to a motor.

It will be evident that the described failure override can also be effective in other types of systems for positioning of a control valve. For example, when the control valve is spring-centered by springs acting on opposite ends of the control valve, it is possible to have an override position at both ends of the control valve whereby when the control valve is shifted to an extreme position when one spring is operative and the other is broken, the swash plate will be moved to neutral position.

The control valve 30 is shown more particularly in FIGS. 2 and 3 with FIG. 2 showing the control valve in the position shown in FIG. 1 and FIG. 3 showing the control valve spool 40 positioned in the failure override position.

The control valve 30 has a case 57 having a bore 58 opening to a case drain in which the valve spool 40 is movable and with the spring 55 operating between an end of the spool 40 and an end cap 59. As shown in FIG. 2, the valve spool has a series of spaced lands including an end land 60, a pair of closely-spaced lands 61 and 62, a second pair of closely-spaced lands 63 and 64, and an end land 65. In the neutral position, the lands 62 and 63 of the pairs of lands block pressure from delivery to the cylinder lines 31 and 32 and these lines connect to drain. Cylinder line 31 is open to a space between lands 64 and 65 and communicates with an internal bore of the valve spool through radial passages 67, with the internal bore communicating with the drain 34 through a radial passage 68. The cylinder line 32 connects with the drain passage 34 through radial ports 69 which communicate with the internal bore of the valve spool.

As the valve spool is shifted to a limited extent to either side of the position shown in FIG. 2, the position of the lands 62 and 63 shifts relative to the cylinder lines 31 and 32 whereby pressure fluid can be delivered to one or the other of said lines while the other of said cylinder lines connects to drain.

When the failure override becomes operative, the spring 55 expands to move the valve spool 40 to the left into an abutting position with a threaded end plug 70. In this position, the annular lands 63 and 64 block the pressure line 33 while the cylinder line 31 can connect to drain by fluid flowing externally of the valve spool to the right-hand end thereof and then flowing through the internal bore to connect to drain through the radial ports 68. The cylinder line 32 connects to drain by flow around the valve spool and through an open passage which is opened by the position of the annular land 62. In the actual construction of the valve, the drain line 34 is not a single line, but the interior of the valve case 57 is generally open to drain.

The failure override for the hydraulic motor control is shown in the embodiment of FIGS. 4 to 6 wherein parts similar to those disclosed in the embodiment of FIGS. 1 to 3 are given the same reference numeral, with a prime affixed thereto. A motor 75, in the form of an axial piston device, has axially movable pistons 76 stroked by means of a swash plate 77 which pivots about a pivot point 78 and controls operation of the motor in response to fluid flow through the lines 79 and 80 which connect to a suitable source, such as the lines 17 and 18 of the pump shown in FIG. 1. A minimum stroke stop 81, which may be in the form of a fixed abutment, is positioned for engagement by a pivot 82 between the link 51' and the piston rod 23' to establish a minimum displacement for the motor which is close to zero displacement.

A control valve, indicated generally at 90, has a neutral position, shown in FIG. 4, wherein the pressure line 33' is blocked and the cylinder lines 31' and 32' connect to the drain line 34'. Through actuation of the command link 45' the control valve can shift to positions at either side of the position shown in FIG. 4 for connecting one of the swash plate-positioning cylinders 20', 21' to pressure and the other cylinder to drain to establish a commanded displacement for the motor and with the valve modulating to maintain the commanded position, with there being feedback from the swash plate through the linkage, similarly to the feedback linkage of the embodiment of FIG. 1.

The control valve 90 is shown more particularly in FIGS. 5 and 6 wherein a valve spool 100 has a hollow bore 101 with a plurality of external lands. The lands include an end land 102 and two pairs of spaced-apart intermediate lands 103, 104, 105, and 106. An additional pair of lands 107 and 108 are at the other end of the spool and have radial ports 109 therebetween communicating the exterior of the spool with the internal bore. In FIG. 5, the valve spool 100 is shown positioned in the neutral position of FIG. 4 wherein the lands 104 and 105 of the intermediate pairs of lands block the pressure line 33' from the cylinder lines 31' and 32'. The latter lines are connected to drain, with cylinder line 32' connected to drain, indicated generally at 110 by flow past land 103 through radial ports 111 to the bore of the valve spool and then through ports 112 to drain. Cylinder line 31' is connected to drain by communication past land 106 to the radial ports 109 and then through the bore of the valve spool to ports 112.

Similarly to the first embodiment, a spring 115 engageable between an end cap 116 and an end of the valve spool urges the valve spool toward the left as viewed in FIG. 5 to eliminate backlash in the linkage system including the feedback structure which establishes the position of the valve. In the event there is a failure in the system, the spring 115 acts to urge the valve spool to the left to the control position shown in FIG. 6 and which is a position shown diagrammatically at the right end of the spool in FIG. 4. In this position, the pressure line 33' connects to the cylinder line 31' to deliver pressure fluid to the cylinder 20' and shift the swash plate 77 to a maximum displacement position. This is desirable upon control failure as when the motor is used in a vehicle drive system. If the vehicle is going down hill upon failure, the motor at maximum displacement generates maximum braking torque at the motor shaft. If the vehicle is going uphill, the shift of the motor to maximum displacement prevents any tendency for the motor to speed up. The failure override position is in effect a fourth position for the valve spool 100. In the fourth position, as shown in FIG. 6, the land 106 is positioned to permit pressure fluid to flow to the cylinder line 31' while the cylinder line 32' is connected to drain by a shifted position of the land 104.

From the foregoing, it will be seen that hazardous failure modes in the control of either a pump or a motor have been eliminated by the addition of a fourth porting position to the control valve and shift of the control valve to the additional position upon the occurrence of a failure. This fourth position is reached if the control valve experiences greater than normal travel due to the failure. A fourth porting position is shown in the control valve in both embodiments. It will be recognized that in the pump control a fifth porting position could be provided which is effective similarly to the fourth position in the event that the control valve experiences greater than normal travel in the direction opposite to that described due to a failure.

I claim:

1. A displacement control for a variable displacement fluid translating device having a movable member for controlling displacement, a circuit including a control device operatively connected to said movable member and a control valve having connections to a source of pressure and a drain for hydraulically operating said control device, means hydraulically connecting the control valve and control device, said control valve having a neutral position wherein said movable member is at or close to a neutral position and at least one other position wherein said movable member is in a displacement-setting position, position-controlling means for setting the position of the control valve, said control valve having a control position not used in normal positioning of the movable member, means operative in response to an operative failure of said position-controlling means for moving the control valve to said control position, and said control valve having means at said control position to establish communication of said control device to one or the other of said connections which enables the movable member to move to a position which minimizes any adverse effects from said failure.

2. A control as defined in claim 1 wherein said fluid translating device is a pump, said movable member is in a neutral position when the control valve is in said neutral position, and said movable member moves to said neutral position when an operative failure occurs.

3. A control as defined in claim 2 wherein said control valve has a first set of flow passages operative at said control position which are the same in function as another set of flow passages operative at the neutral position of the control valve.

4. A control as defined in claim 3 wherein said control device includes a piston and cylinder with spring means operative to urge the movable member to said neutral position, and said sets of flow passages are operative to block control pressure from said cylinder and connect the cylinder to drain.

5. A control as defined in claim 2 wherein said position-controlling means includes feedback means operatively connected between said movable member and the control valve.

6. A control as defined in claim 2 wherein said movable member is movable to a position either side of said neutral position and said control valve has two of said other positions at opposite sides of said neutral positions, and said control position is a fourth position for the control valve.

7. A control as defined in claim 1 wherein said fluid translating device is a motor and said movable member moves to a maximum displacement position when an operative failure occurs.

8. A control as defined in claim 7 wherein said control valve has a set of flow passages operative when the control valve is in said other position to connect control pressure to the control device, and another set of flow passages identical in function to said first set of passages operative when the control valve is in said control position.

9. A control as defined in claim 8 wherein said control device includes a pair of pistons and cylinders, and said sets of flow passages are operative to connect control pressure to one of said cylinders and connect the other cylinder to drain.

10. A control as defined in claim 7 wherein said position-controlling means includes feedback means operatively connected between said movable member and the control valve.

11. A control as defined in claim 7 wherein said control valve has at least three positions for control of the position of the movable member, and said control position is an additional position.

12. A displacement control for a variable displacement pump having a swash plate for controlling displacement, a circuit including a control device operatively connected to said swash plate and a control valve having connections to a source of pressure and a drain for hydraulically operating said control device, said control valve having a neutral position wherein said swash plate is in a neutral position for zero displacement and a range of other positions wherein said swash plate is in a displacement-setting position, position-controlling means for setting the position of the control valve, said control valve having a control position other than said neutral position which enables the swash plate to move to said neutral position, and means operative in response to an operative failure of said position-controlling means for moving the control valve to said control position.

13. A displacement control for a variable displacement pump having a swash plate for controlling displacement, a fluid circuit including a pair of control pistons and cylinders operatively connected to said swash plate with spring means urging the swash plate to a neutral position and a control valve having connections to a source of pressure and a drain for hydraulically operating said control cylinders, said control valve having a neutral position wherein said control cylinders are connected to drain and the swash plate is in a neutral position and at least one other position wherein said swash plate is in a displacement-setting position, position-controlling means for controlling the position of the control valve including feedback means between the swash plate and the control valve, said control valve being movable to a control position other than said neutral position which connects the cylinders to drain whereby the swash plate moves to said neutral position, and means operative in response to an operative failure of said position-controlling means for moving the control valve to said control position.

14. A control as defined in claim 13 wherein said control valve is positionable to either side of said neutral position for controlling pump displacement and said control position is an additional position.

15. A control as defined in claim 14 wherein said position control means includes mechanical linkages and said means for moving the control valve to a control position is a spring which acts on said control valve and urges said control valve to the control position if there is a failure in said linkages.

16. A displacement control for a variable displacement motor having a swash plate for controlling displacement, a circuit including a control device operatively connected to said swash plate and a control valve having connections to a source of pressure and a drain for hydraulically operating said control device, means hydraulically connecting the control valve and control device, said control valve having a neutral position and at least one other position wherein said swash plate is in a displacement-setting position, position-controlling means for setting the position of the control valve, said control valve being movable to a control position not normally used in control of the swash plate which causes the swash plate to move to a maximum displacement position, and means operative in response to an operative failure of said position-controlling means for moving the control valve to said control position.

17. A displacement control for a variable displacement motor having a swash plate for controlling displacement, a circuit including a pair of control pistons and cylinders operatively connected to said swash plate and a control valve having connections to a source of pressure and a drain for hydraulically operating said control cylinders, means hydraulically connecting the control valve and control device, said control valve having a neutral position wherein said cylinders are blocked from pressure and at least one other position wherein said swash plate is in a displacement-setting position, position-controlling means for controlling the position of the control valve including feedback means between the swash plate and the control valve, said control valve being movable to a control position not used in normal positioning of the swash plate which connects one of the cylinders to pressure and moves the swash plate to a maximum displacement position, and means operative in response to an operative failure of said position-controlling means for moving the control valve to said control position.

18. A control as defined in claim 17 wherein said control valve is positionable to either side of said neutral position for controlling motor displacement and said control position is an additional position.

19. A control as defined in claim 18 wherein said position control means includes mechanical linkages and a spring acts on said control valve to take up backlash in said linkages and urges said control valve to the control position if there is a failure in said linkages.

* * * * *